US008361365B2

(12) United States Patent
Hovanec et al.

(10) Patent No.: US 8,361,365 B2
(45) Date of Patent: Jan. 29, 2013

(54) PROCESS FOR ELECTROBLOWING A MULTIPLE LAYERED SHEET

(75) Inventors: Joseph Brian Hovanec, Richmond, VA (US); Michael John Moore, Sr., Colonial Heights, VA (US)

(73) Assignee: E I du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 12/002,175

(22) Filed: Dec. 14, 2007

(65) Prior Publication Data

US 2008/0157440 A1 Jul. 3, 2008

Related U.S. Application Data

(60) Provisional application No. 60/875,925, filed on Dec. 20, 2006.

(51) Int. Cl.

| | |
|---|---|
| ***B29C 47/06*** | (2006.01) |
| *B32B 5/02* | (2006.01) |
| *D04H 3/02* | (2006.01) |

(52) U.S. Cl. ..... 264/205; 425/72.2; 425/131.5; 425/174.6; 264/172.19; 264/465

(58) Field of Classification Search ..... 264/172.19, 264/465, 205, 204; 425/72.2, 131.5, 174.6
See application file for complete search history.

(56) References Cited

U.S. PATENT DOCUMENTS

| | | | | |
|---|---|---|---|---|
| 2,048,651 | A * | 7/1936 | Norton | 264/10 |
| 3,901,675 | A * | 8/1975 | Buchanan et al. | 65/514 |
| 4,017,580 | A * | 4/1977 | Barbey | 264/103 |
| 6,723,669 | B1 * | 4/2004 | Clark et al. | 442/347 |
| 7,160,091 | B2 * | 1/2007 | Baumeister | 425/72.2 |
| 7,351,052 | B2 * | 4/2008 | Chun et al. | 425/174.8 R |
| 7,717,975 | B2 * | 5/2010 | Kalayci et al. | 55/486 |
| 7,927,540 | B2 * | 4/2011 | Smithies et al. | 264/454 |
| 2002/0042128 | A1 * | 4/2002 | Bowlin et al. | 435/366 |
| 2002/0089094 | A1 * | 7/2002 | Kleinmeyer et al. | 264/465 |
| 2002/0175449 | A1 * | 11/2002 | Chu et al. | 264/465 |
| 2004/0070118 | A1 * | 4/2004 | Czado | 264/465 |
| 2005/0067732 | A1 * | 3/2005 | Kim et al. | 264/172.19 |
| 2005/0073075 | A1 * | 4/2005 | Chu et al. | 264/465 |
| 2005/0104258 | A1 * | 5/2005 | Lennhoff | 264/465 |
| 2005/0253305 | A1 * | 11/2005 | Kim et al. | 264/465 |
| 2006/0137318 | A1 | 6/2006 | Lim et al. | |
| 2006/0138711 | A1 * | 6/2006 | Bryner et al. | 264/465 |
| 2006/0200232 | A1 * | 9/2006 | Phaneuf et al. | 623/1.42 |
| 2007/0040305 | A1 * | 2/2007 | Armantrout et al. | 264/465 |
| 2008/0213417 | A1 * | 9/2008 | Bryner et al. | 425/72.2 |
| 2010/0007063 | A1 * | 1/2010 | Laxton et al. | 264/492 |
| 2010/0013127 | A1 * | 1/2010 | Kim et al. | 264/465 |
| 2010/0041296 | A1 * | 2/2010 | Lopez et al. | 442/351 |
| 2010/0255745 | A1 * | 10/2010 | Liles et al. | 442/376 |
| 2012/0077280 | A1 * | 3/2012 | Chase et al. | 436/164 |
| 2012/0099244 | A1 * | 4/2012 | Lee et al. | 361/502 |
| 2012/0157904 | A1 * | 6/2012 | Stein | 602/43 |
| 2012/0164514 | A1 * | 6/2012 | Hayakawa et al. | 429/144 |
| 2012/0225358 | A1 * | 9/2012 | Seo et al. | 429/246 |

FOREIGN PATENT DOCUMENTS

| | | |
|---|---|---|
| WO | WO 03/080905 | 10/2003 |
| WO | WO 03/080905 A1 | 10/2003 |
| WO | WO 2004074559 | 9/2004 |
| WO | WO 2005/090653 | 9/2005 |

OTHER PUBLICATIONS

PCT International Search Report and Written Opinion for International Application No. PCT/US2007/025796 dated Dec. 18, 2007.

* cited by examiner

*Primary Examiner* — Joseph Del Sole
*Assistant Examiner* — Nahida Sultana

(57) ABSTRACT

A process for electroblowing a multiple layered sheet using multiple spinning beams to produce different component webs wherein the sheet doesn't stick to the forming screen and has improved web stability.

5 Claims, No Drawings

PROCESS FOR ELECTROBLOWING A MULTIPLE LAYERED SHEET

FIELD OF THE INVENTION

The present invention is related to an improvement for electroblowing a multiple layered sheet.

BACKGROUND OF THE INVENTION

Fabrics and webs made from fibers can be used in a variety of customer end-use applications, such as filtration media, energy storage separators, protective apparel and the like. A process to make these webs is electroblowing wherein a polymer solution is spun through a nozzle in the presence of an electrostatic field and a blowing or forwarding fluid to evaporate the solvent and form fibers that are collected on a screen. Typically, not all of the solvent is removed from the fibers at laydown requiring additional solvent removal processes. However, if too much solvent remains in the fiber at fiber laydown on the screen, then the web can stick to the screen resulting in web damage when removing the web from the screen. Also, if too little solvent remains in the fiber at fiber laydown on the screen, then the web does not exhibit sufficient tackiness for good surface stability to allow for web handling.

What is needed is a process for electroblowing a sheet structure that can be removed from the collection screen while having sufficient surface stability for handling.

SUMMARY OF THE INVENTION

The present invention is directed to a process for electroblowing a multiple layered sheet comprising spinning an electrically conductive liquid stream comprising a polymer dissolved in a solvent through at least two spinning beams comprising a linear array of spinning nozzles in the presence of a forwarding gas and an electric field to form fibers and deposit the fibers onto a collecting screen, wherein: (a) a first spinning beam provides fibers that are deposited onto the collecting screen with a solvent concentration of about 0 to about 30 weight percent that make a first web; and (b) a second spinning beam provides fibers that are deposited onto the first web with a solvent concentration of about 30 to about 70 weight percent that make a second web, wherein the difference in solvent concentration between the webs is at least about 10 weight percent.

DETAILED DESCRIPTION OF THE INVENTION

The present invention is related to an improvement for a multiple layered sheet made from webs produced by an electroblowing process described in World Patent Publication No. WO 03/080905, corresponding to U.S. patent application Ser. No. 10/477,882, incorporated herein by reference in its entirety.

The electroblowing method comprises feeding a stream of polymeric solution comprising a polymer and a solvent from a storage tank to a series of spinning nozzles within a spinneret, to which a high voltage is applied and through which the polymeric solution is discharged. Meanwhile, compressed air that is optionally heated is issued from air nozzles disposed in the sides of, or at the periphery of the spinning nozzle. The air is directed generally downward as a blowing gas stream which envelopes and forwards the newly issued polymeric solution and aids in the formation of the fibrous web, which is collected on a grounded porous collection screen above a vacuum chamber.

The polymer solution can be mixed with additives including any resin compatible with an associated polymer, plasticizer, ultraviolet ray stabilizer, crosslink agent, curing agent, reaction initiator and etc. Although dissolving most of the polymers may not require any specific temperature ranges, heating may be needed for assisting the dissolution reaction.

It has been observed that in preparing a web according to this electroblowing process, if the web contains fibers with too much solvent at laydown on the collection screen, then the web sticks to the screen causing damage to the web upon removal from the screen. The sticking problem can be averted if the web at laydown has a solvent concentration of about 0 to about 30 weight percent.

It has been further observed that in preparing a web according to this electroblowing process, if the web contains fibers with too little solvent at laydown on the collection screen, then the fibers do not have sufficient tackiness to stick to each other in order to develop enough surface stability to prevent web damage when handling the web. The surface stability can be improved if the web at laydown has a solvent concentration of about 30 to about 70 weight percent.

A multiple layered sheet according to the invention can be made by combining a low solvent containing web with a high solvent containing web that does not stick to the collection screen while providing sufficient surface stability for web handling. The multiple layered sheet can be made by spinning a polymer solution through a first spinning beam that provides fibers that are deposited onto the collecting screen with a solvent concentration of about 0 to about 30 weight percent to make a first web and a second spinning beam provides fibers that are deposited onto the first web with a solvent concentration of about 30 to about 70 weight percent to make a second web, wherein the difference in solvent concentration between the webs is at least about 10 weight percent.

One way to make webs with different solvent concentrations at laydown is to control the liquid stream throughput of the polymer solution exiting the spinning beam. The first web can be prepared by spinning the fiber from a spinning beam that has a liquid stream throughput per nozzle of about 0.5 to about 2.0 cc/hole/min. The second web can be prepared by spinning the fiber from a spinning beam that has a liquid stream throughput per nozzle of about 2.0 to about 4.0 cc/hole/min. The difference in throughput between the two liquid streams is at least about 1 cc/hole/min.

Another way to make webs with different solvent concentrations at laydown is to control the forwarding gas temperatures. The first web can be prepared by spinning the fiber with a first forwarding gas with a temperature of about 50° C. to about 150° C. The second web can be prepared by spinning the fibers with a second forwarding gas with a temperature of about 25° C. to about 50° C. The difference in temperature between the forwarding gases is at least about 25° C.

Alternative process variables that can be manipulated to independently control the fiber spun from each spinning beam to achieve the desired level of solvent concentration at laydown include spinning cell temperature and die to collector or beam to collection screen distance.

Additional spinning beams can be added to the process to deposit additional webs between the first and second webs, onto the second web or a combination of both.

The process further comprises removing the solvent from the collected webs to a desired solvent content depending on the end use.

A preferred polymer/solvent combination is polyamide dissolved in formic acid to prepare a polyamide multiple layered sheet.

TEST METHOD

Solvent Content in a web is measured by weighing the as produced web, then drying the web and reweighing the web and is calculated by the formula:

$$\% \text{ solvent} = \frac{(\text{weight of solvent containing web} - \text{weight of solvent free web})}{(\text{weight of solvent containing web})} \times 100\%$$

EXAMPLES

Hereinafter the present invention will be described in more detail in the following examples.

Webs used to make a multiple layered sheet of the present invention can be produced by the electroblowing process described in World Patent Publication No. WO 2003/080905, corresponding to U.S. patent application Ser. No. 10/477,882, incorporated herein by reference in its entirety.

Comparative Example A

A web is prepared from a polymer solution having a concentration of 24 wt % of nylon 6,6 polymer, Zytel® FE3218 (available from E. I. du Pont de Nemours and Company, Wilmington, Del.) dissolved in formic acid solvent at 99% purity (available from Kemira Oyj, Helsinki, Finland). The polymer solution is electrospun at room temperature using blowing air at a temperature of about 50° C. and potential difference between the spinning beam and the collector of 50 kV. A spinning beam has a polymer solution throughput of about 4.0 cc/hole/min which produces fibers that are collected on a screen to form a web with about 60% formic acid content. The web sticks to the collection screen causing damage to the web when it is removed.

Comparative Example B

Another web is prepared in a similar manner to Comparative Example A except the spinning beam has a polymer solution throughput of about 1.0 cc/hole/min which produces fibers that are collected on a screen to form a web with about 25% formic acid content. The web does not stick to the collection screen when it is removed. However, the surface stability of the web is insufficient to stop damage to the web when handling.

Example 1

A multiple layered sheet according to the invention is made by combining Comparative Examples A and B in a specific order. As in Comparative Example B, a first spinning beam has a polymer solution throughput of about 1.0 cc/hole/min which produces fibers that are collected on a screen to form a first web with about 25% formic acid content. As in Comparative Example A, a second spinning beam has a polymer solution throughput of about 4.0 cc/hole/min which produces fibers that are collected on top of the first web to form a second web with about 60% formic acid content. The two webs produce a multiple layered sheet. The sheet is removed from the screen without sticking to the screen. Furthermore, the additional tackiness of the second web helps to hold the sheet together with good surface stability allowing the web to be handled. The multiple layered sheet is solvent stripped to remove residual formic acid.

What is claimed is:

1. A process for electroblowing a multiple layered sheet comprising spinning an electrically conductive liquid stream comprising a polymer dissolved in a solvent through at least two spinning beams comprising a linear array of spinning nozzles in the presence of a forwarding gas and an electric field to form fibers and deposit the fibers onto a collecting screen, wherein: a first spinning beam provides fibers that are deposited as a web onto the collecting screen with where the web at laydown has a solvent concentration of about 0 to about 30 weight percent by weight of the web; and a second spinning beam provides fibers that are deposited onto the first web as a second web at laydown with a solvent concentration of about 30 to about 70 weight percent by weight of the second web, wherein the difference in solvent concentration between the webs is at least 10 weight percent; wherein the first spinning beam has a first forwarding gas with a temperature of about 50° C. to about 150° C. and the second spinning beam has a second forwarding gas with a temperature of about 25° C. to about 50° C. wherein the difference in temperature between the forwarding gases is at least about 25° C.

2. The process of claim 1, further comprising:

(c) one or more additional spinning beams provides fibers that are deposited between the first and second webs, onto the second web, or a combination of both and make up one or more additional webs.

3. The process of claim 1, further comprising removing the solvent from the collected fibers.

4. The process of claim 1, wherein the first spinning beam has a liquid stream throughput per nozzle of about 0.5 to about 2.0 cc/hole/min and the second spinning beam has a liquid stream throughput per nozzle of about 2.0 to about 4.0 cc/hole/min wherein the difference in throughput between the liquid streams is at least about 1 cc/hole/min.

5. The process of claim 1, wherein the polymer is polyamide and the solvent is formic acid.

* * * * *